United States Patent [19]

Freeman

[11] 4,330,059

[45] May 18, 1982

[54] PLANT SHIPPING AND DISPLAY CONTAINER

[76] Inventor: Leslie C. Freeman, 22721 Locust Way, Bothell, Wash. 98011

[21] Appl. No.: 171,734

[22] Filed: Jul. 24, 1980

[51] Int. Cl.[3] ..... B65D 85/52; B65D 81/02; B65D 65/24

[52] U.S. Cl. ..... 206/423; 206/44 R

[58] Field of Search ..... 206/423, 44 R, 45.12

[56] References Cited

U.S. PATENT DOCUMENTS

| | | | |
|---|---|---|---|
| 1,606,523 | 11/1926 | Gardner | 206/423 |
| 1,669,717 | 5/1928 | Kennedy | 206/423 |
| 2,259,041 | 10/1941 | Larkin | 206/44 R |
| 3,021,046 | 2/1962 | Pullen | 206/423 |
| 3,087,666 | 4/1963 | Kitchell | 206/423 |
| 3,342,329 | 9/1967 | Knight | 206/423 |

*Primary Examiner*—William T. Dixson, Jr.
*Attorney, Agent, or Firm*—Seed, Berry, Vernon & Baynham

[57] ABSTRACT

A corrugated paper shipping and display carton for potted plants. The carton includes a rectangular sheath having a front-to-back dimension which is approximately equal to the width of the pot so that the pot is gripped by the carton. The carton has a width which is substantially larger than the width of the pot to provide sufficient space on either side of the plant for air circulation. A pair of tabs extend inwardly from the front and back of the carton to engage opposite portions of the top edge of the pot to center the pot in position on a base portion of the carton. The carton utilizes horizontal corrugations to maximize the strength of the tabs. Two or more cartons may be strapped together between top and bottom trays to form a unitary multipack. A displaceable front panel has preformed slots formed along its edges which terminate in breakaway portions so that the front panel may be folded downwardly to provide an opening to the interior of the carton for easy access and display.

9 Claims, 6 Drawing Figures

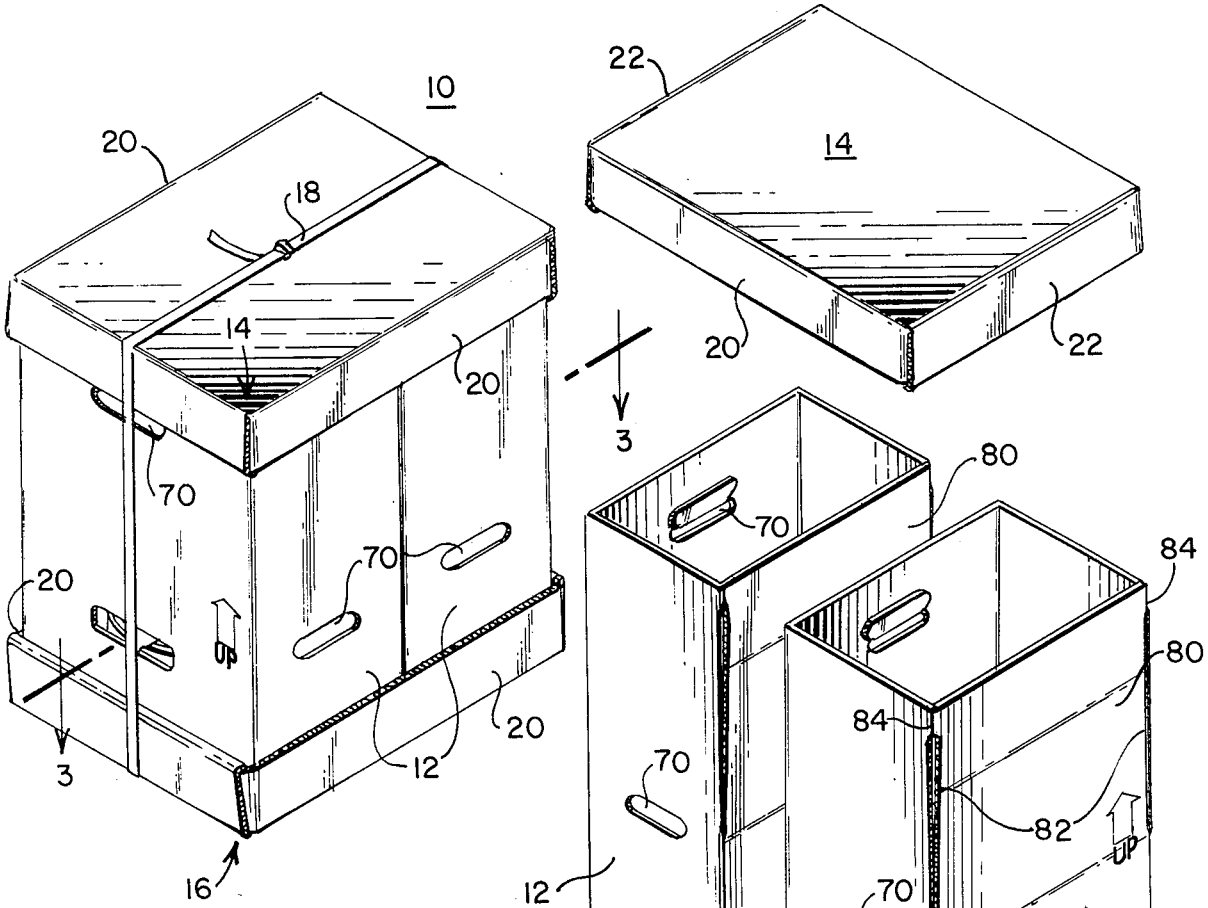
FIG. 1
FIG. 2
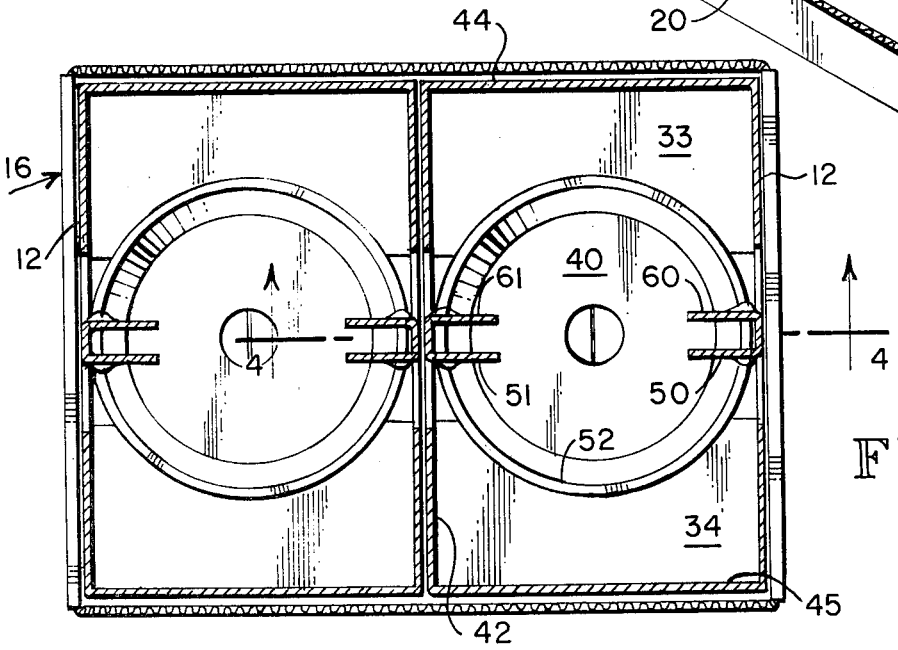
FIG. 3

PLANT SHIPPING AND DISPLAY CONTAINER

BACKGROUND OF THE INVENTION

1. Field of the Invention

This invention relates to transportable shipping and display cartons for potted plants and the like.

2. Prior Art Related to the Disclosure

Heretofore, fuchsia, ivy, geraniums and other bushy plants have been subject to damage when being transported. The spreading foliage encompasses substantial volume and limits the number of plants that can be transported without some sort of cover or restricting means being placed around the foliage. Damage to foliage is a problem throughout the distribution chain for such plants, beginning with the grower and on through intermediate distributors, retail outlets, and ending with the consumer or purchaser who must transport the plant from the place of purchase.

One system utilized by growers has been the use of soft plastic flared sleeves which force the branches of a plant upwardly and into a relative small volume. Because of the dense packaging of the foliage, air circulation is restricted and the plant often is damaged. Consequently, the maximum shelf life for plants packaged in this manner is a day or so. Removal of a plant from such a device at a retail outlet results in broken branches, and the softness of the cover provides minimal protection against damage in transport.

Another method for protecting plants is to place two or more plants into a cardboard container. This often results in damage to the plants since nothing is provided for holding the pot for each plant firmly in position.

SUMMARY OF THE INVENTION

It is therefore an object of this invention to provide a stiff cardboard plan protector which confines a plant's foliage to a restricted space without damaging that foliage.

It is another object of the invention to provide a shipping container for plants which provides for free circulation of air about the plant, increasing the shelf life of said plant within the container.

It is another object of the invention to provide locking tabs for centering and holding the plant firmly in position within a protective cover.

It is another object of the invention to provide for protected transportation of a multiplicity of plants each contained within an individual protective covers.

In accordance with these and other objects of the invention, a corrugated paper shipping and display carton for potted plants is provided. The carton includes a horizontal base upon which rests a pot for the plant. A cardboard sheath extends vertically from the base, and a pair of inwardly projecting tabs for locking the pot in place on the carton each project inwardly from opposite sidewalls to engage opposite sides of the top edges of the pot. The carton also has a displaceable side panel portion provided by preformed vertical slots which terminate in breakaway portions so that the panel is foldable to provide an opening for access to the interior of the carton and for display purposes. One embodiment of the invention includes tabs which are integrally formed in the corrugated front and rear walls to hold the pot in position. The corrugations of the walls preferably extend horizontally to maximize the strength of the tabs. The lower edges of the tabs are preferably positioned slightly below the upper edge of the pot so that indentations are formed in the tabs by the top edge of the pot when the tabs are bent inwardly. A multi-carton shipping package is formed by placing two or more cartons between top and bottom trays which are banded together for shipping.

BRIEF DESCRIPION OF THE DRAWINGS

FIG. 1 is an isometric view of a multi-carton shipping package for two or more cartons according to the invention;

FIG. 2 is an exploded isometric view of the multi-carton shipping package;

FIG. 3 is a cross-sectional view taken along the line 3—3 of FIG. 1 of a multi-carton shipping package utilizing a corrugated paper shipping and display carton according to the invention;

DETAILED DESCRIPTION OF THE PREFERRED EMBODIMENT

Figure 4:
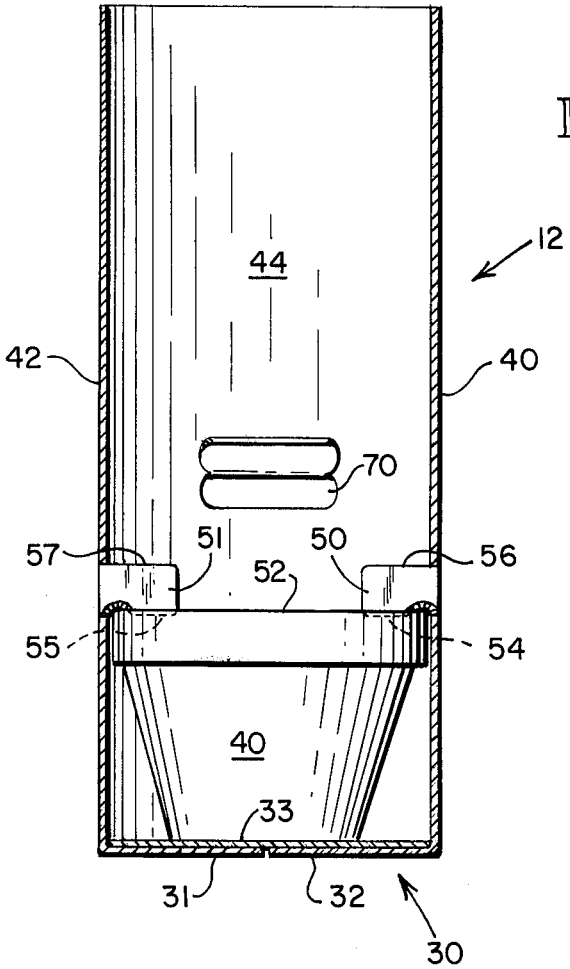
FIG. 4 is a cross-sectional view taken along section line 4—4 of FIG. 3 of a portion of a shipping and display carton.

Referring now to the drawings, FIGS. 1 and 2 show the components of a multi-carton shipping package 10 which provides protection for transporting potted plants having bushy foliage relatively large in proportion to the size of the pot for each plant. The figures show a pair of shipping and display cartons 12, each of which is adapted to locking a potted plant in position on the base of its carton. A top tray 14 and a bottom tray 16 each formed of corrugated paper provide protection for the cartons 12 by the trays being bound together to form the multi-carton shipping package 10 using a conventional banding strap 18. The turned up sides 20 of each of the trays 14, 16, as well as the turned up ends 22, which are folded over tab portions 24 of the sides 20, keep adjacently positioned shipping packages 10 separated and serve as shock-absorbent bumpers between multi-carton shipping packages.

Figure 5:
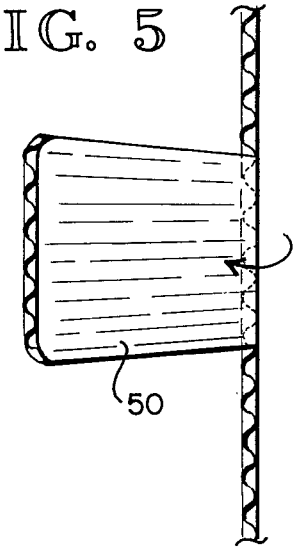
FIG. 5 is a detailed view of a tab according to the invention.

The structure for each of the corrugated paper shipping and display cartons 12 is shown in more detail in FIGS. 3, 4 and 5. A carton 12 includes a horizontal base 30 which is formed by flaps 31, 32, 33, 34 extending from respective sidewall panels of the carton and folded over, as shown in FIG. 4, and glued to form said base. A typical pot 40 is shown in FIG. 4 resting upon the horizontal base 30 of the carton 12.

Each carton 12 has a sheath which includes a front wall 40 spaced apart from a parallel rear wall 42 and a pair of sidewalls 44, 45 positioned opposite each other, as shown in FIG. 3. The corners between the wall panels are formed by bending corrugated paper sheets and the top portion of each carton is open to provide free circulation of air for a plant contained therein.

Extending inwardly from the front wall 40 and rear wall 42 of a sheath are a pair of tabs 50, 51. The corrugations of the tabs 50, 51 are horizontal to resist sideways horizontal displacement of the tabs and hold the tabs in position. Vertical corrugations would permit folding of the tabs along a vertical line and consequent sideways displacement of the tabs.

The tabs 50, 51 are positioned to project out over the top edge 52 of the pot 40. The position of the lower edges 54, 55 of each of the tabs 50, 51 with respect to the base 30 is slightly less than the height of the pot 40 so that the edge 52 of the pot 40 forms respective indentations 56, 57 in the tabs 50, 51 when the tabs 50, 51 are pushed over the pot 40, as shown in FIG. 4. The tabs thus lock the pot in position within the carton. The tabs 50, 51 are preferably integrally formed from the front and rear wall panels 40, 42. FIG. 3 shows additional adjacent tabs 60, 61 formed as mirror images of the tabs 50, 51. These additional tabs 60, 61 serve the same function as the tabs 50, 51.

Note that the distance between the sidewalls 44, 45 is substantially greater than the distance between the front and rear walls 40, 42. When a pot 40 is locked in position in the center of the base 30, this arrangement provides sufficient room to the sides to permit the branches and leaves of the bushy plant to spread and to allow air circulation around the plant. A series of cutouts 70 are formed in the walls of the cartons to provide handholds and external air circulation ports for the carton 12.

Figure 6:
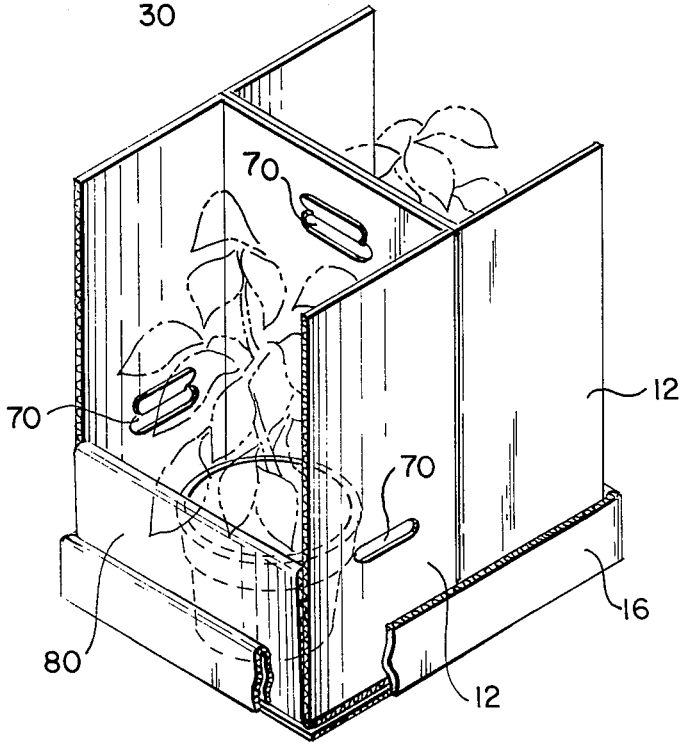
FIG. 6 is an isometric view of a pair of shipping and display cartons, each having their displaceable front panels folded downwardly to display the plants contained therein.

Referring to FIG. 6, a pair of back-to-back cartons 12 are shown on a bottom tray 16. The cartons 12 are constructed such that the tops thereof are open to provide access to and air circulation for the plant. Additional access and air circulation are provided by a displaceable panel portion 80 formed by slots 82 at the corners of the carton, as indicated in FIG. 2. The portions 84 near the top of a carton are not slotted, but form breakaway portions which are easily cut or torn to permit the displaceable panel 80 to be folded downwardly, as shown in FIG. 6, and provide an opening for air circulation as well as for display of the foliage of a plant (typically shown) having a pot fixed to the base 30 of a carton 12.

The corrugated paper carton 12 thus provides a relatively stiff, protective housing for the foliage of a plant. The inwardly extending tabs 50, 51 locked on opposite sides of the pot hold the pot in position on the base of the carton. The large front opening provided by the displaceable panel 80 permits display of the foliage of a plant without having to remove the pot from the carton. This carton thus not only permits a potted plant to be safely transported from the grower to the retailer's place of business, but also permits the foliage of the plant to be displayed for sale and eventually transported by a customer without having to remove the pot from the carton 12. The tabs 50, 51 lock a pot in position and prevent damage to both the pot and to the foliage of a plant by preventing shifting of a plant within the carton.

I claim:

1. A corrugated paper shipping and display carton for potted plants, comprising:

a horizontal base upon which rests a pot;

a sheath having front, back and sidewall panels extending vertically from the base, the spacing between the front and back walls being approximately equal to a transverse dimension of said pot so that said pot contacts the front and rear walls of said sheath; and a pair of inwardly projecting tabs projecting from said front wall and said back wall above opposite side of the pot, with the lower edges of said tabs engaging the upper edge of the pot to hold the pot in position on the base.

2. The carton of claim 1 wherein the front panel of the sheath includes breakaway means for facilitating separation of the portion of the front panel above the pot from the remainder of the sheath to permit said portion to be folded downwardly to provide an opening to the interior of the carton and allow access to and display of the plant foliage.

3. The carton of claim 2 wherein the breakaway means include preformed slots along the side edges of the front panel and relatively thin webs formed at each upper corner of the front panel above a respective slot which may be severed to allow the front panel to be folded downwardly.

4. The carton of claim 1 wherein the tabs are integrally formed in the corrugated sidewalls, with the corrugations extending horizontally to maximize the strength and stiffness of the tabs.

5. The carton of claim 1 wherein the lower edges of the tabs are positioned slightly below the upper edge of the pot so that when the respective tabs engage the top edge of the pot, indentations are formed therein to assist in holding the pot in position within the carton.

6. The carton of claim 1, further including top and bottom trays between which two or more cartons are placed and including means for holding the trays in position to provide a multi-carton shipping package for two or more cartons.

7. The carton of claim 1 wherein the cross-section of the sheath and the base upon which the pot rests are rectangular, having a width dimension approximately the width of the pot and a length greater than the width dimension of the pot so that the pot is locked in position by the tabs projecting from the front and back walls of the sheath and space is provided to the sides of the pot to allow for air circulation and spreading of the plant foliage within the sheath.

8. A shipping and display carton for potted plants, comprising a rectangular box having a rectangular bottom panel on which the plant is placed, an open top, and rectangular front, back and side panels formed by paperboard which is corrugated along a line parallel to the bottom panel, the width of the side panels being approximately equal to the width of the pot so that the pot contacts the front and back panels, the width of the front and back panels being substantially greater than the width of the pot so that the foliage of the plant can expand toward the side panels of the box, said box further including respective pairs of tabs integrally formed with the box projecting inwardly from the approximate middle of the front and back panels near the upper edge of the pot along a line parallel to the bottom panel, the spacing of the lower edges of the tabs from the bottom panel being slightly less than the spacing of the upper edge of the pot from the bottom panel so that when the respective tabs engage the top edge of the pot, indentations are formed therein to assist in holding the pot in position.

9. The shipping and display carton of claim 8 wherein a slot is formed along each side edge of the front panel from a point below the midpoint of the front panel to near, but not up to, the upper edge of the front panel, thereby forming a relatively thin web at each upper corner of the front panel which may be served to allow the front panel to be folded downwardly to provide an opening into the interior of the box for access and display purposes.

* * * * *